United States Patent [19]

Nakata et al.

[11] Patent Number: 4,553,011

[45] Date of Patent: Nov. 12, 1985

[54] TEMPERATURE CONTROL FOR MICROWAVE OVEN

[75] Inventors: Takeshi Nakata; Atsushi Horinouchi; Kazuo Taino, all of Otsu, Japan

[73] Assignee: Sanyo Electric Co., Ltd., Osaka, Japan

[21] Appl. No.: 687,698

[22] Filed: Dec. 31, 1984

[30] Foreign Application Priority Data

Dec. 29, 1983 [JP] Japan ..... 58-249517

[51] Int. Cl.[4] ..... H05B 6/68

[52] U.S. Cl. ..... 219/10.55 B; 219/10.55 M; 99/325

[58] Field of Search ..... 219/10.55 B, 10.55 R, 219/10.55 E, 10.55 M; 99/325, 451, DIG. 14; 374/749

[56] References Cited

U.S. PATENT DOCUMENTS 4,217,477 8/1980 Matsubara et al. ..... 219/10.55 B
4,220,840 9/1980 Barker ..... 219/10.55 B
4,345,134 8/1982 Tanaka et al. ..... 219/10.55 B
4,499,357 2/1985 Kojima ..... 219/10.55 B

FOREIGN PATENT DOCUMENTS 53-12698 5/1978 Japan .
55-9359 1/1980 Japan .

*Primary Examiner*—Philip H. Leung
*Attorney, Agent, or Firm*—Armstrong, Nikaido, Marmelstein & Kubovcik

[57] ABSTRACT

In a microwave oven in which microwave heating is controlled by the output value of a temperature sensor, a microcomputer is provided to control the microwave heating in such a manner that the microwave heating is continued until the output value of the temperature sensor exceeds a first temperature, and once the output value exceeds the first temperature, the microwave heating is stopped for several periods of time and the output value of the temperature sensor is detected for avoiding the bad effect of noise due to the microwave oscillation.

5 Claims, 6 Drawing Figures

TEMPERATURE CONTROL FOR MICROWAVE OVEN

FIELD OF THE INVENTION

The present invention relates to an electronic oven for heating foods or the like, and more particularly to a microwave oven in which temperature of food to be heated is sensed by temperature sensing means and microwave heating is controlled on the basis of a temperature thus sensed.

BACKGROUND OF THE INVENTION

In a conventional microwave oven as shown in FIG. 1, microwave oscillated by a magnetron 1 is fed to a heating chamber 4 provided in a oven body 3' through a wave guide 2, whereby a food 6 laid on a turn table 5 can be heated by microwave. A temperature sensor of an infrared temperature sensor 7 is provided in the exterior of the heating chamber for sensing the temperature of the food 6 by receiving infrared rays radiated from the food 6, whereby the output of the magnetron is controlled on the basis of the temperature signal produced by the sensor 7.

In general, the aforementioned microwave ovens are so arranged as to prevent leakage of microwaves out of the heating chamber. However, it has been very difficult to completely suppress leakage of the microwave out of the chamber, and therefore, in the conventional microwave ovens the output of the temperature sensor is accompanied by noise due to the leaked microwave.

More specifically, for example, where such leakage of the microwave occurs, one example of the output signal of the sensor 7 is depicted in FIG. 5 from which it is clearly seen that the temperature signal is accompanied by the noise, and the output of the sensor 7 increases as the cooking time lapses with remarkable fluctuation of the output value due to the noise. When such signal including the noise as shown in FIG. 2 is used as the temperature control signal of the microwave oven, assuming that the desired cooking temperature is T1, if the sensor 7 produces a temperature signal of T1 which is increased by the noise despite that an actual temperature of the food in the oven is T2 which is lower than the desired temperature T1, the microwave oven stops heating at the time A with the actual food temperature T2, then the food may be badly finished.

As mentioned above, the conventional microwave oven has a disadvantage that the S/N ratio of the output signal of the sensor 7 is lowered by the noise and a correct temperature control of the food in the microwave oven can not be performed by the noise and a good finish of cooking can not be expected.

Furthermore, in the microwave oven, there tends to occur the temperature difference between the surface and the inner portion of the food, i.e., the surface of the food is at the desired temperature but the inner portion of the food is lower than the desired temperature. If the microwave heating is finished under such state, a good finish of the cooking can not be made since the temperature of the food as a whole may be lower than the desired temperature.

Japanese patent publication NO. 12698/1978 discloses a way of detecting the temperature of the food for used in a microwave oven in which the temperature of the food is detected during stoppage of the magnetron. Also Japanese patent publication (unexamined) No. 9359/1980 discloses a microwave oven in which the temperature of the food is repeatedly compared with a predetermined value a plurality of times, whereby the microwave heating is stopped. However, both of the prior arts do not solve the above mentioned problems.

In attempting to prevent such incomplete finishing of the cooking mentioned as above by merely exciting the magnetron again after short interruption of the magnetron until the entire food is heated up to the desired temperature, excitation and interruption of the magnetron may be undesirably frequently repeated.

SUMMARY OF THE INVENTION

An essential object of the present invention is to provide a microwave oven which enables to eliminate the effect of the noise due to leakage of microwave for effecting a correct temperature control, thereby enabling a correct cooking with a good finish.

A further object of the present invention is to provide a microwave oven for preventing incomplete cooking due to the temperature difference of the food.

A still further object of the present invention is to provide a microwave oven which prevents frequent interruption and excitation of the magnetron before the food is heated up to the desired temperature.

According to the present invention, there is provided a microwave oven which comprises microwave oscillating means for oscillating the microwave for heating food, temperature sensing means for sensing the temperature of the food to be heated and control means for controlling the oscillation of the oscillating means.

According to one aspect of the microwave oven according to the present invention, the control means is formed by a microcomputer with such operation program that the output of the temperature sensing means is detected while the microwave oscillation means is excited and if the output of the temperature sensing means exceeds the desired temperature, the micro wave oscillation means is stopped, the output of the sensing means is detected while the microwave oscillation means is stopped so as to sense the correct output of the temperature sensing means without noise due to oscillation of the microwave and the actual temperature of the food being heated. Where the output of the temperature sensing means, with the oscillation means stopped, continues to exceed the desired temperature after a predetermined period of time, the microcomputer judges that the food is heated to the desired temperature. On the other hand, if the output drops below the desired temperature during such predetermined period microwave oscillations are restarted and the temperature sensing cycle is repeated. In either event, good finish of cooking results.

These and other aspects and the objects of the present invention will be explained below in conjunction with the preferred embodiment with reference to the attached drawings.

DETAILED DESCRIPTION OF A PREFERRED EMBODIMENT

Figure 3:
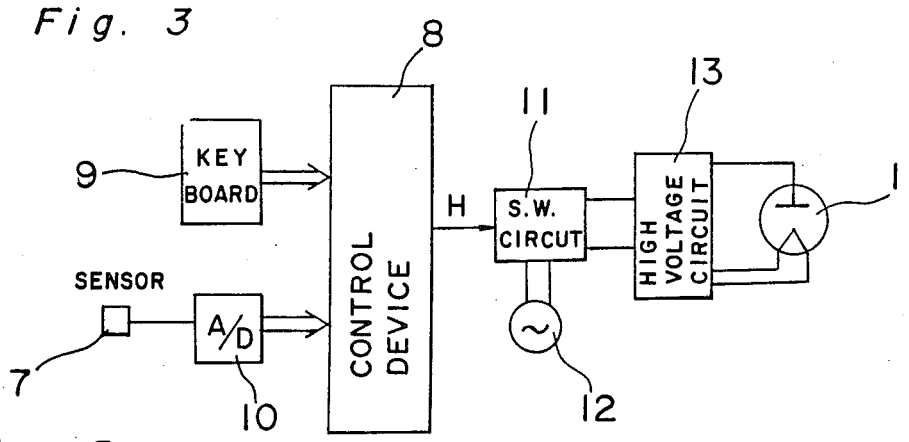
FIG. 3 is a schematic block diagram of one embodiment of a microwave oven according to the present invention.

Referring to FIG. 3 showing a block diagram of a preferred embodiment of a microwave oven according to the present invention, in which a control device 8 using a microcomputer serves to control the microwave oven. The control device 8 receives various control signals such as a desired temperature information fed from a keyboard 9 which is provided on a front control panel (not shown) of the microwave oven body 3 and a detected temperature information which is sensed by the infrared sensor 7 in an analog form and converted into the digital form in an analog/digital converter 10 (referred to as A/D converter hereinafter) and in turn the control device 8 produces a heating signal H on the basis of the desired temperature information and the detected temperature information. When the heating signal H is produced from the control device 8, a switching circuit 11 formed by one or more bidirectional thyristors (not shown) becomes ON so that the power can be supplied to a high voltage circuit 13 from the commercial power source 12, and in turn the high voltage power generated by the high voltage circuit 13 is supplied to a magnetron 1 to oscillate the microwave power, whereby the food on turn table is heated.

Figure 4:
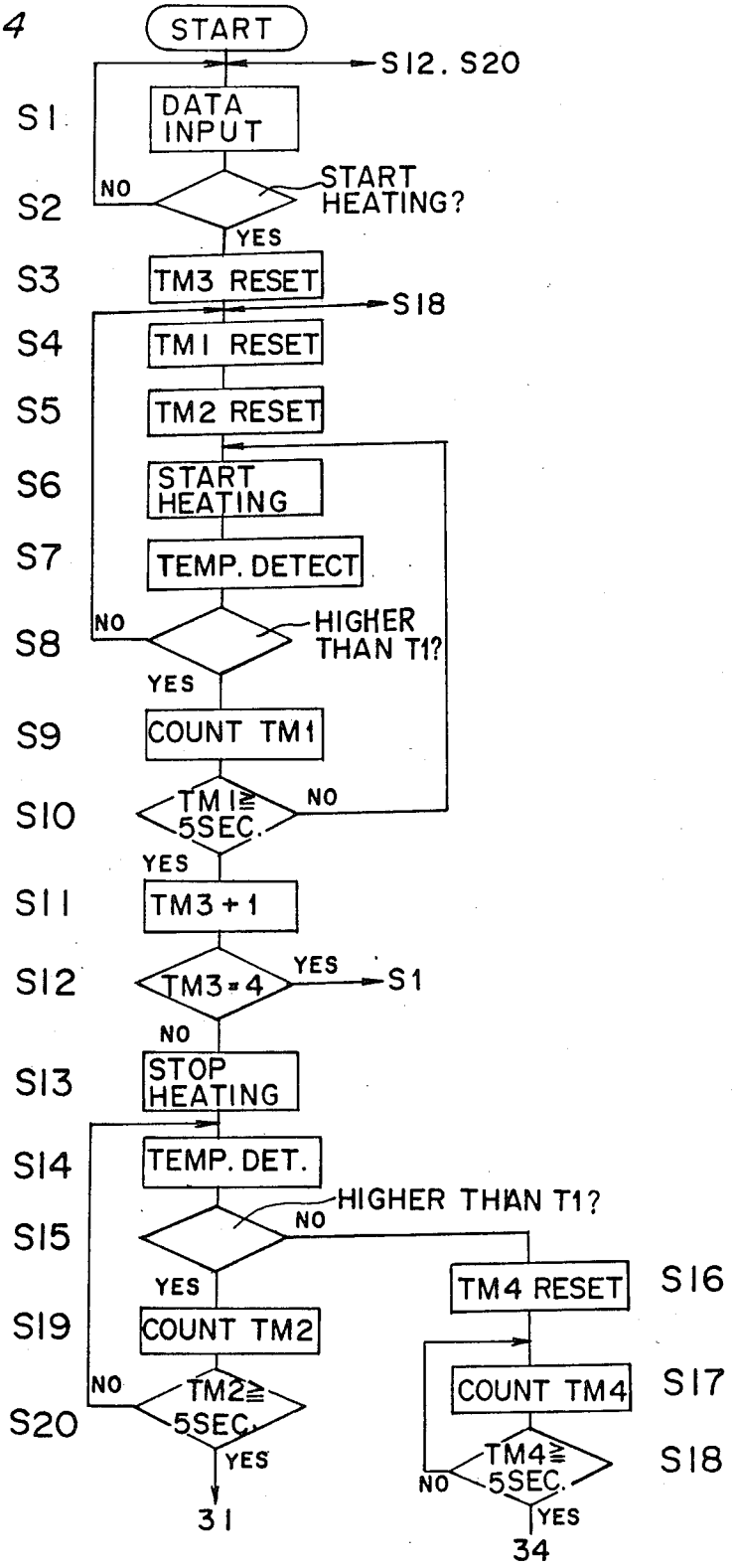
FIG. 4 is a flow chart showing an operation of the microwave oven shown in FIG. 3.

The heating operation is executed on the basis of a control program stored in the control device 8 in a manner as described below with reference to the control flow chart shown in FIG. 4.

Figure 1:
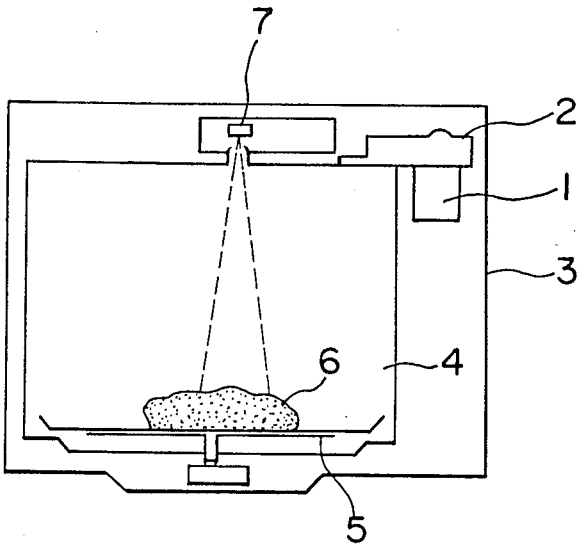
Fig. 1 (prior art)
FIG. 1 is a schematic diagram showing an essential portion of a conventional microwave oven.
Figure 2:
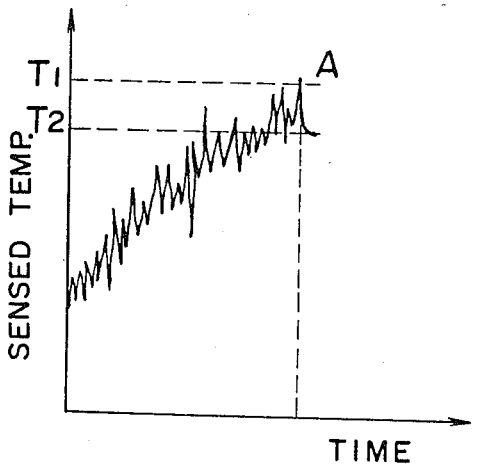
Fig. 2 (prior art)
FIG. 2 is a graph showing one example of output signal of a temperature sensor used in the conventional microwave oven.

In the normal state, the control program circulates the steps S1 and S2. In the step S1, various information designated by the operation of keys in the key board 9 enter the control device 8. In the step S2, it is judged whether or not the instruction fed from the keyboard is to start heating. Upon operation of the numeric keys so called ten keys (not shown) of the key board 9 to input the data of the desired temperature T1 for cooking, the desired temperature data signal is taken in the control device 8 at the step S1 and the program flow progresses to the step S3 through step S2, wherein a third counter TM3 in the control device 8 is reset. The program flow circulates the steps S4 through S8. A first counter TM1 and a second counter TM2 in the control device 8 are respectively reset in the steps S4 and S5. In the step S6, the heating signal H is generated so that the magnetron starts oscillation to generate the microwave and then the heating operation is executed. The detected temperature information of the food to be heated is fed to the control device 8 from the infrared sensor 7 which is disposed out of the heating chamber as shown in FIG. 1 and the detected temperature or the output of the infrared sensor 7 is taken in the control device 8 in the step S7 and in turn it is judged whether or not the output of the infrared sensor 7 is reached at the first temperature or the desired temperature T1 in the step S8.

Figure 5:
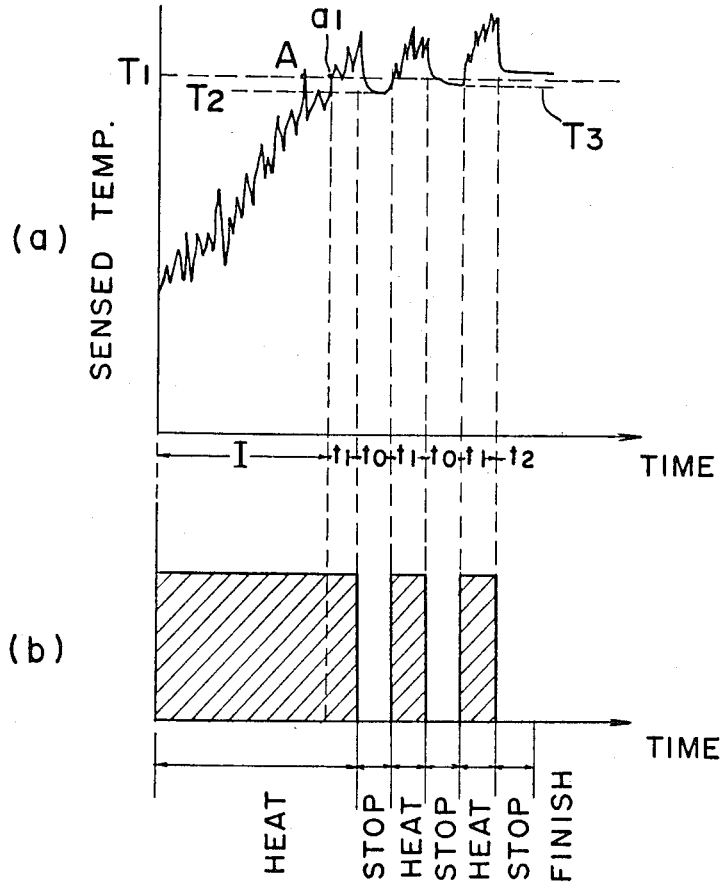
FIG. 5*a* is a graph showing an output of an infrared sensor used in the embodiment of the microwave oven according to the present invention.
FIG. 5*b* is a timing chart showing an example of operation of the microwave oven shown in FIG. 3.

As the heating of the food is progressed, the temperature of the food is increased, and the output of the infrared sensor 7 is increased with fluctuation due to the noise of leakage of the microwave as shown in the range I. FIG. 5*b* shows one aspect of heating operation in terms of heating time and the shaded areas show the periods during which microwave heating is made.

When the instantaneous value of the output value of the infrared sensor 7 reaches or exceeds the desired temperature T1 at the time A due to the noise, the program flow progresses to the step S9 wherein time is counted by the first counter TM1. Then it is checked in the step S10 whether the content of the first counter TM1 exceeds 5 seconds. If the period of time counted by the first counter TM1 is shorter than 5 seconds, the program flow returns to the step S6 to circulate the steps S6 through S10. During repetition of these steps S6 through S10, if the output of the infrared sensor 7 is lower than T1, this is detected in the step S8 and the program flow returns to the step S4 to reset the first counter T1 and circulates the steps S4 through S8 to continue the microwave heating.

As the microwave heating is progressed, the temperature of the food increases and the output value of the infrared sensor 7 also increases with the fluctuation due to the noise. When the actual temperature of the food exceeds over the temperature T1, thus the output value of the infrared sensor 7 exceeds constantly over T1, the program flow circulates the steps S6 through S10. In a case where the output value of the infrared sensor 7 exceeds over the temperature T1 continuously more than the period of time set by the counter TM1, or 5 seconds in this example, the program flow progresses to the step S11, wherein a value "1" is added to the third counter TM3 and in turn it is judged in the step S12 whether or not the contents of the third counter TM3 is "4". If the contents of the third counter TM3 is not "4", since in this example the content is "1", the program flow progresses to the step S13, wherein the control device 8 stops to produce the heating signal H, thereby stopping generation of the microwave from the magnetron 1 by stopping the application of the high voltage thereto. Then the program flow progresses to the step S15 through the step S14, the operation of which is similar to the step S7. In the step S15, it is judged whether or not the output value of the infrared sensor 7 exceeds over the second temperature T1. During this operation, the magnetron 1 is stopped and the microwave heating is stopped, no noise is superimposed on the output signal of the infrared sensor 7, so that the output value of the infrared sensor 7 represents a correct actual temperature of the food to be heated. If the temperature sensed by the infrared sensor 7 is the second temperature T2 which is lower than the desired temperature T1, the program flow progresses to the step S16 to reset the fourth counter TM4, which is in turn started to count the time in the step S17, then it is judged in the step S18 whether or not the contents of the fourth counter TM4 exceeds 5 seconds (T0). The program flow circulates the steps S17 and S18 until the content of the fourth counter TM4 exceeds 5 seconds. When 5 seconds are lapsed, the program flow returns to the step S4.

At the step S6 the heating signal H is again generated from the control device 8 to start excitation of the magnetron 1 again so that heating of the food by microwave is started again. Under such state, the output of value of the infrared sensor fluctuates by the leaked microwave noise. If the output value of the infrared sensor 7 exceeds the first temperature T1, the program flow circulates the steps S7 through S10 and returns to the step S6. Where the first period of time t1 of 5 seconds is elapsed, the program flow progresses to the step S11 again, wherein the content of the third counter TM3 is made "2", and in turn the program flow progresses to the step S13 through the step S12, thereby stopping the microwave heating of the food. Then the output value of the infrared sensor 7 is detected in the step S14 so as to detect the correct temperature without noise. If the output value of the infrared sensor 7 representing the correct temperature of the food is T3 which is still lower than the desired temperature T1, the program flow circulates the steps S17 and S18 through the step S16 during 5 seconds, then returns to the step S4, further circulating the steps S6 through S10 during 5 seconds of the first period t1. Thereafter, the program flow progresses to the step S13 through the step S12, thereby stopping the microwave heating. Then the correct temperature is detected in the step S14. If the temperature of the food thus detected is or exceeds over the desired temperature T1, the program flow progresses to the step S19 from the step S15. In the step S19, the second counter TM2 counts the time and it is judged in the step S20 whether or not the content of the second counter TM2 exceeds 5 seconds. If the content of the second counter TM2 is shorter than 5 seconds, the program flow returns to the step S14 and circulates the steps S14, S15, S19 and S20 during the second period of time t2 of 5 seconds so far as the temperature of the food detected by the infrared sensor 7 is higher than the desired temperature T1. When the second period of time t2 of 5 seconds lapses, the microwave heating is completed, so that the program flow returns to the step S1 to receive the input information from the key board 9 for waiting the subsequent heating operation.

In this embodiment, it is consecutively judged whether or not the temperature of the food is reached T1 for five seconds by the steps S19 and S20. This is made for eliminating an irregular temperature distribution in the food which tends to occur in the microwave oven. Namely, assuming that the steps S19 and S20 are omitted, if it is detected that the temperature T1 of the food may be reached in only one judging process with the inner portion of the food not reached the temperature T1, thereby erroneously judging that the heating of the food is finished. However, the microwave oven according to the present invention is provided with the steps S19 and S20, in a case where the inner portion of the food is lower than T1, the temperature of the surface of the food can be lowered below T1 during the judging process of the temperature of the food for five seconds due to the heat conduction from the surface to the inner portion of the food, whereby the program flow comes back to the step S15 wherein the low temperature of the food can be detected so that the food can be heated again. As the result, the entire food can be heated up to the desired temperature T1, thereby finishing the heating. It is one advantage of provision of the program steps S17 and S18 to prevent frequent interruption of the magnetron. Namely, without the steps S17 and S18, in a case where the temperature of the food once exceeds the desired temperature with the magnetron stopped and thereafter the temperature of the food falls down lower than the desire temperature immediately then the magnetron may be ignited again to heat the food. The program steps S17 and S18 serve to prevent such frequent interruption of the magnetron.

As mentioned above, the microwave oven according to the present invention acts to detect the output value of the infrared sensor for the first period of time t1 of 5 seconds for example judging whether or not the output value exceeds the desired temperature T1 during exciting of the magnetron, subsequently it is detected for the second period of time t2 with the magnetron stopped whether or not the output of the infrared sensor exceeds the desired temperature T1 as the second temperature, whereby the control device 8 can judge that the actual temperature of the food is reached to the correct desired temperature T1.

In the operation mentioned above, if it is detected at the step S12 that the content of the third counter TM3 is 4, the program flow returns to the step S1 so that after repetition of heating of 4 times and stopping of the heating of 4 times, then the heating of the food is ended.

It is noted that the sampling period of detecting the output of the infrared sensor 7 may be determined as desired, for example, the sampling period may be 1 second. For this operation, a step of the program of waiting for 1 second is put directly before each of the step S7 and S14.

It is further noted that the temperature T1 used in the step S8 and the temperature T1 used in the step S15 may be different value so far as the food can be heated up substantially to the desired temperature.

Although the present invention is described with reference to the preferred embodiment, various modification can be made without departing from the spirit and the scope of the present invention, for examples, as the temperature sensor, a temperature probe which employs a temperature sensing unit such as a thermistor and is used by inserting the probe in the food to be heated can be used.

What is claimed is

1. A microwave oven which comprises microwave oscillating means for oscillating the microwave for heating food, temperature sensing means for sensing the temperature of the food to be heated, control means for controlling the oscillation of the oscillating means and instruction means for instructing activation of the oscillating means, said control means including (a) input detecting means for detecting the instruction fed from the instruction means, (b) means for activating said oscillating means in response to the instructions fed from the instruction means, (c) first detecting means for detecting whether the output value of the sensing means exceed a first value continuously during a first predetermined period, (d) first means for deactivating said oscillating means corresponding to the detection of the first detecting means, (e) second detecting means for detecting whether the output value of the sensing means exceed a second value continuously during a predetermined second period while said oscillation means is stopped, and (f) means for enabling said input detecting means in response to the output of the second detecting means.

2. The microwave oven according to claim 1, wherein the first value and the second value substantially correspond to the desired temperature to which the food is to be heated.

3. The microwave oven according to claim 1, wherein said control means further includes (g) means for reactivating said oscillating means, said first detecting means, said first deactivating means and said second detecting means, one after the other in the sequence and under the conditions recited in (b), (c), (d) and (e) when said detecting means detects that the output value of the sensing means is less than said second value for said second predetermined.

4. The microwave oven according to claim 3, including means for deactivating said microwave after the operation of (g) is repeated a predetermined number of times.

5. The microwave oven according to claim 1, wherein said temperature sensing means is an infrared sensor.

* * * * *